US012258685B2

(12) United States Patent
Peuker et al.

(10) Patent No.: US 12,258,685 B2
(45) Date of Patent: Mar. 25, 2025

(54) SLIVER PREPARATION

(71) Applicant: Saurer Intelligent Technology AG, Arbon (CH)

(72) Inventors: Heinz-Josef Peuker, Wegberg (DE); Chandrassekaran Seshayer, Herzogenrath (DE); Dirk Schiffers, Korschenbroich (DE); Sarah Meissner, Geilenkirchen (DE)

(73) Assignee: Saurer Intelligent Technology AG, Arbon (CH)

( * ) Notice: Subject to any disclaimer, the term of this patent is extended or adjusted under 35 U.S.C. 154(b) by 0 days.

(21) Appl. No.: 18/521,159

(22) Filed: Nov. 28, 2023

(65) Prior Publication Data

US 2024/0209551 A1 Jun. 27, 2024

(30) Foreign Application Priority Data

Dec. 22, 2022 (LU) ..... 503240

(51) Int. Cl.
*D01H 5/74* (2006.01)
*D01H 5/32* (2006.01)

(52) U.S. Cl.
CPC ..... *D01H 5/74* (2013.01); *D01H 5/32* (2013.01)

(58) Field of Classification Search
CPC .. D01H 4/02; D01H 4/48; D01H 5/22; D01H 5/26; D01H 5/32
See application file for complete search history.

(56) References Cited

U.S. PATENT DOCUMENTS 4,545,193 A * 10/1985 Tanaka ..... D01H 15/002 57/22
5,704,204 A * 1/1998 Mima ..... D01H 15/002 57/328

(Continued)

FOREIGN PATENT DOCUMENTS

DE 10102379 A1 7/2002
DE 102004050968 A1 4/2006

(Continued)

OTHER PUBLICATIONS

Search Report issued in corresponding Luxembourg Application No. LU 503240, dated Jul. 5, 2023 (7 pages).
U.S. Appl. No. 18/538,768.

*Primary Examiner* — Shaun R Hurley
(74) *Attorney, Agent, or Firm* — FLYNN THIEL, P.C.

(57) ABSTRACT

A drafting system for conveying a sliver to an inlet opening of a vortex chamber of an air-jet spinning device, for a drafting system having an exit roller pair and at least one additional drafting system roller pair and/or apron roller pair. A sliver is supplied at a spinning station of an air-jet spinning machine for the production of a thread to the vortex chamber. The exit roller pair can be driven decoupled from the at least one additional pair of drafting system rollers and/or apron rollers. In the method, the roller pair is driven for combing the sliver end after a spinning interruption at a predetermined combing speed and the at least one stretching mill roller and/or belt roller pair upstream of the starting roller pair is stopped or operated at a holding speed associated with the combing speed, which is at most 10% of the combing speed.

10 Claims, 2 Drawing Sheets

(56) References Cited

U.S. PATENT DOCUMENTS

Figure 1:
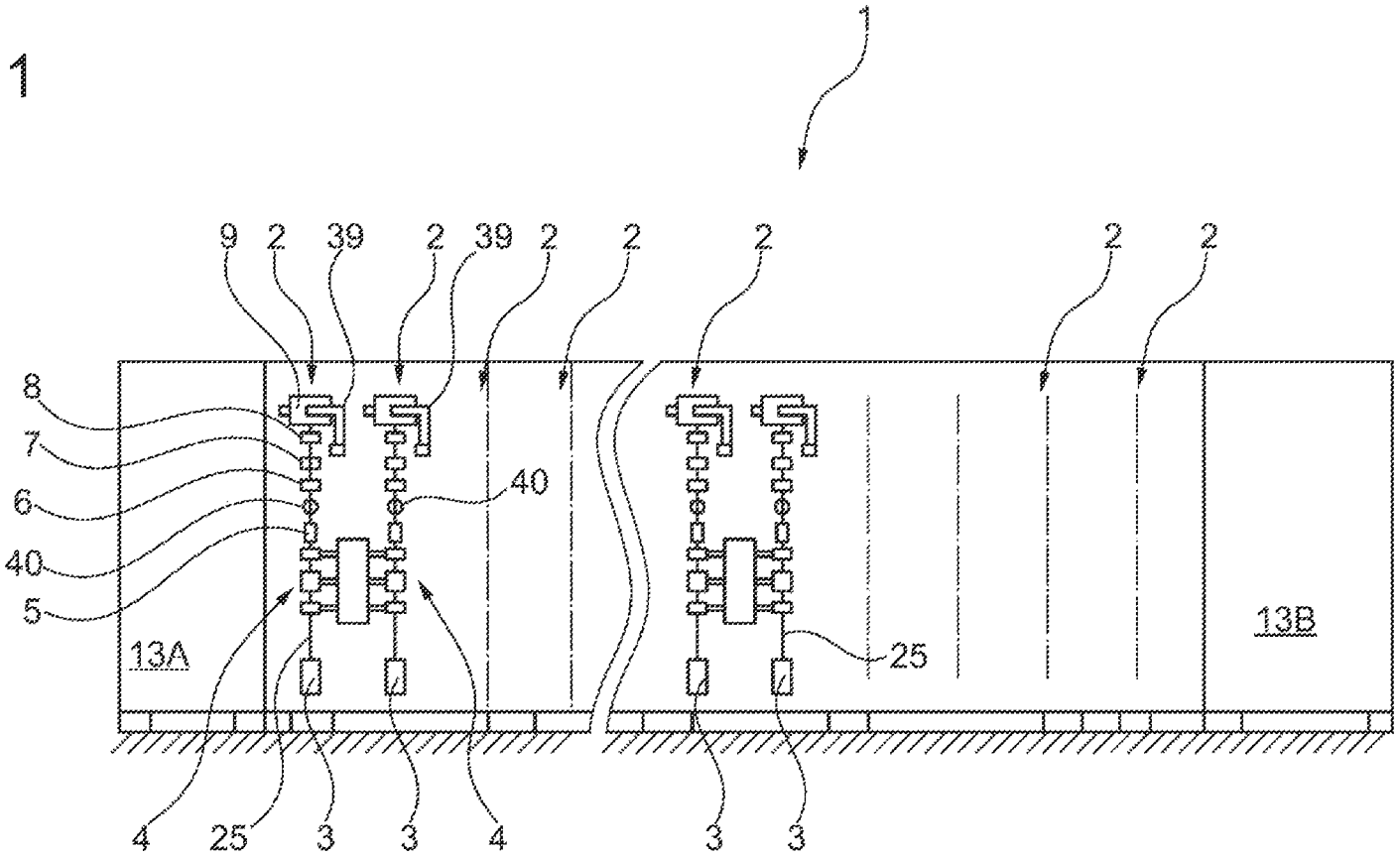

| | | | | | |
|---|---|---|---|---|---|
| 5,809,764 | A * | 9/1998 | Baba | D01H 1/115 | 57/263 |
| 6,691,501 | B2 | 2/2004 | Anderegg et al. | | |
| 6,792,744 | B2 | 9/2004 | Feuerlohn et al. | | |
| 6,959,532 | B2 * | 11/2005 | Wust | D01H 15/002 | 57/22 |
| 7,464,530 | B2 | 12/2008 | Stahlecker et al. | | |
| 2002/0124545 | A1 * | 9/2002 | Griesshammer | D01H 5/005 | 57/317 |
| 2002/0144496 | A1 * | 10/2002 | Anderegg | D01H 15/002 | 57/261 |

FOREIGN PATENT DOCUMENTS

| | | | | | |
|---|---|---|---|---|---|
| EP | 1219737 | A1 | 7/2002 | | |
| EP | 1329542 | A2 | 7/2003 | | |
| EP | 1347085 | A2 * | 9/2003 | D01H 1/115 | |
| EP | 1347085 | B2 | 9/2003 | | |
| EP | 3330416 | A1 * | 6/2018 | D01H 1/115 | |
| WO | WO-2019012143 | A2 * | 1/2019 | B65H 51/16 | |

* cited by examiner

SLIVER PREPARATION

The invention relates to a drafting system for conveying a sliver in the direction of an inlet opening of a vortex chamber of an air-jet spinning device, as well as to a method for operating a drafting system having an exit roller pair and at least one additional drafting system roller pair and/or apron roller pair, by means of which a sliver is supplied at a spinning station of an air-jet spinning machine for the production of a thread to a vortex chamber of the air-jet spinning device, wherein the exit roller pair can be driven decoupled from the at least one additional pair of drafting system rollers and/or apron rollers.

Generic drafting systems and methods for their operation in a spinning station of an air-jet spinning machine are known in various embodiments from the prior art. At the spinning stations of such air-jet spinning machines, the drafting systems serve to supply a sliver to a vortex chamber of an air-jet spinning device of the spinning station, wherein said sliver is stretched beforehand.

In the course of the spinning process, defects repeatedly occur in which thread sections arise whose parameters such as the thread thickness, the hairiness, the thread strength, etc. deviate from a predetermined setpoint. Such thread defects are detected by a thread sensor and must be removed in a cleaner cut interrupting the spinning process. Likewise, during the spinning process, thread breaks occur in which the thread tears, which also necessitates re-attachment of the thread end to the sliver supplied by the drafting system to the air-jet spinning machine in the vortex chamber.

To carry out the piecing process, it is necessary to pick up the particular thread end that has run onto a take-up bobbin from the take-up bobbin with the aid of a spinning station's thread take-up device or one that can be moved past the spinning station, in particular one that is arranged to be movable on the air-jet spinning machine, in order to transfer it into the vortex chamber of the air-jet spinning device against the actual thread path direction during the spinning process, in order to join it there to the supplied sliver. To prepare the thread end for connection to the supplied sliver, it is necessary to prepare the thread end before piecing for connection to the sliver. A thread preparation device is used for this purpose which is downstream from the vortex chamber in the thread running direction and serves to cut the thread end to a predefined length and unravel the thread end, i.e. undo its existing twist so that it can be connected to the supplied sliver. After the thread end has been unraveled, it is transported into the vortex chamber and held there, for example by means of blown air, with the release of a clamp that positions the thread end in the thread preparation device.

In the piecing process which then taking place, the sliver is supplied via the drafting system to the vortex chamber via the exit roller pair, and is connected to the free thread end placed there, forming a thread in the vortex chamber, and is then drawn off from the vortex chamber via the draw-off device.

At the beginning of the piecing process, the drafting system is first powered up, whereby the sliver is conveyed toward the vortex chamber. The draw-off device is only started after the drafting system has powered up so that at the beginning of the piecing process, there is a dwell time for the thread end in the vortex chamber during which the sliver fed via the drafting system is joined to the thread end in the vortex chamber. After the dwell time has elapsed, both the draw-off device and the exit roller pair are accelerated up to a predetermined draw-off speed at which the spinning process is then continued.

Careful preparation of the free sliver end is of particular importance for error-free connection of the thread end to the sliver in the context of the piecing process. However, known drafting systems and methods for sliver preparation using these drafting systems only enable the desired conditioning of the sliver end prior to the piecing process to a limited extent.

Proceeding from this, the object of the invention is to provide a method for operating a drafting system having an exit roller pair and at least one additional drafting system roller pair and/or an apron roller pair, as well as a drafting system which enables reliable preparation of the sliver end before the piecing process.

Characteristic of the method according to the invention is that the exit roller pair for combing out the sliver after an interruption of spinning is driven at a predetermined combing-out speed, and the at least one pair of drafting system rollers and/or apron rollers located upstream from the exit roller pair in the sliver running direction is stopped or operated at a holding speed which is associated with the combing-out speed and which amounts to a max. 10% of the combing-out speed.

During regular spinning operation, the exit roller pair of the drafting system and the the draw-off device have a matching production speed, referred to as the draw-off speed, wherein the at least one drafting system roller pair and/or apron roller pair, which is located upstream from the exit roller pair as viewed in the direction of thread travel, has a lower production speed due to the system, in order to achieve the desired drafting of the sliver within the drafting system.

According to the method according to the invention, it is provided that the exit roller pair, which can be driven by the at least one additional drafting system roller pair and/or apron roller pair, is driven at a predetermined combing speed, while the at least one additional upstream drafting system roller pair and/or apron roller pair is stationary or is operated at a low holding speed which amounts to a maximum of 10% of the combing speed. Such a combing-out operation of the drafting system causes no or only very slight feeding of the sliver in the direction of the vortex chamber of the air-jet spinning device. Rather, in particular with a stationary drafting system roller pair and/or apron roller pair and an operation of the exit roller pair at the predetermined combing-out speed, the sliver end is conditioned by this combing process so that it can be prepared in an optimal manner for the piecing process at the free thread end arranged in the vortex chamber.

According to a development of the invention, it is provided that when the drafting system is powered up, the exit roller pair is driven before the at least one additional drafting system roller pair and/or apron roller pair when the drafting system is powered up during piecing. This embodiment of the invention makes it possible to avoid fluctuations when powering up the exit roller pairs, as a result of which fibers are not conveyed at the speed specified by the rest of the drafting system and which can lead to additional drafting of the sliver or a build-up of the fibers.

In principle, it is possible, following the combing-out process in which the exit roller pair is operated in a decoupled manner from the at least one additional drafting roller pair and/or apron roller pair, which are stationary or operated only at an assigned holding speed, to power up and convey the prepared sliver into the vortex chamber of the air-jet spinning device. According to another embodiment of the invention, it is however provided that the drafting system is stopped after combing and then powered up for piecing.

This embodiment of the invention particularly reliably ensures that the free sliver end is arranged in the desired manner at the beginning of the piecing process in the vortex chamber for connection to the free thread end.

A control unit for carrying out the above-described or further developed method according to the invention for operating a drafting system after an interruption of spinning is characteristic for the drafting system for conveying a sliver in the direction of an inlet opening of a vortex chamber of an air-jet spinning device, wherein the drafting system has an exit roller pair which can be driven decoupled from the at least one additional drafting system roller pair and/or apron roller pair. The control unit can be arranged directly at the spinning station or, according to an advantageous further development of the invention, integrated into a central control unit for more than one spinning station or the air-jet spinning machine. The central control unit can preferably be a mobile or stationary device outside the spinning station and/or air-jet spinning machine. Particularly advantageously, the control unit is provided to variably adjust the combing-out speed and/or the holding speed so that an optimal adaptation to the fibers is made possible.

Figure 2:
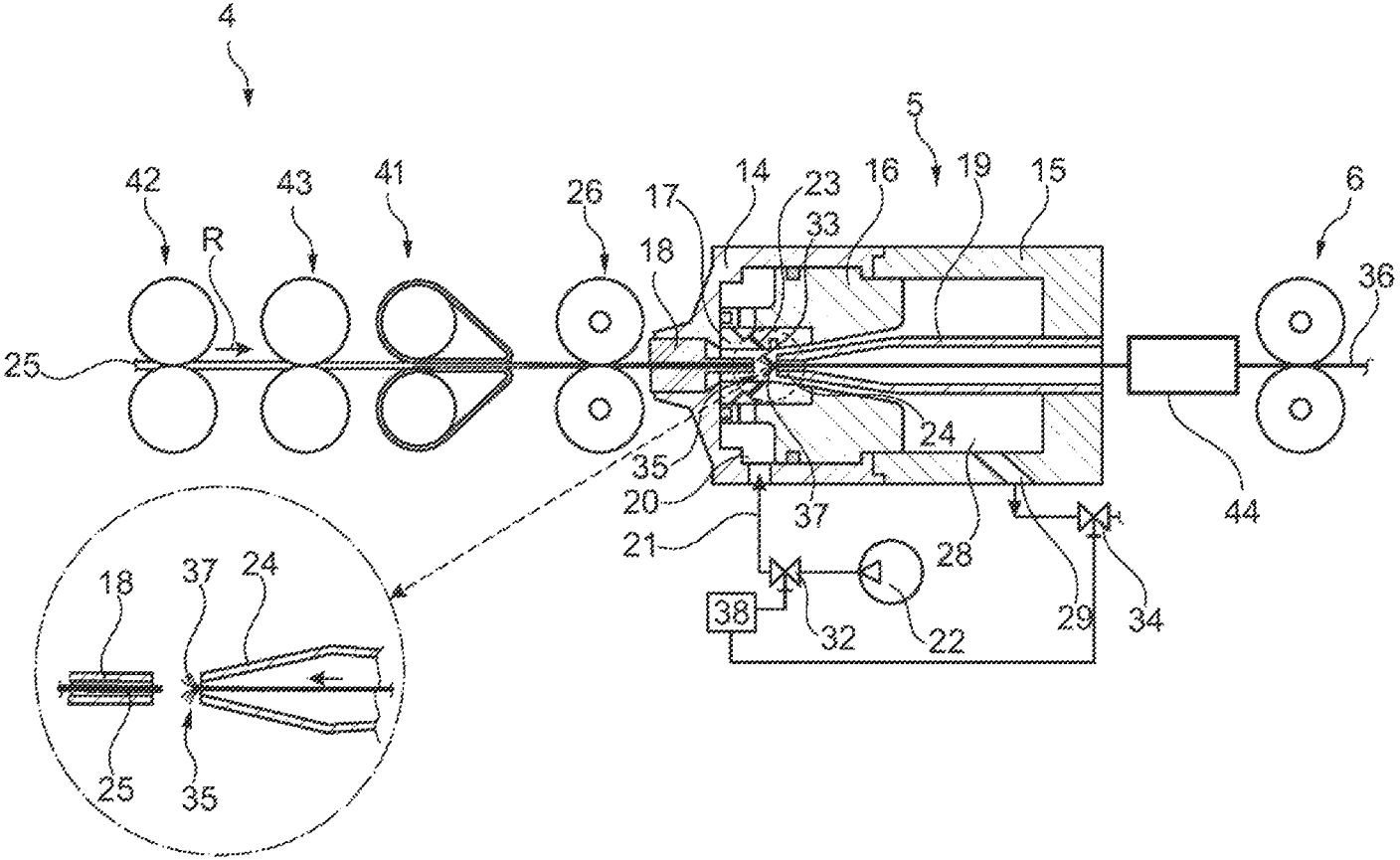

An exemplary embodiment of the invention is explained below with reference to the drawings. In the drawings:

FIG. 1 shows a front view of an air-jet spinning machine with workstations that each having a workstation-specific thread take-up device and a thread preparation device for supplying its air-jet spinning device, and FIG. 2 shows a sectional view in a schematic representation of an air-jet spinning device during the piecing process.

FIG. 1 schematically shows, in a front view, a textile machine that is usually referred to as a cross-wound bobbin 9, producing an air-jet spinning machine 1 in the present case. Such textile machines 1 have a plurality of spinning stations 2 between machine frames 13A, 13B arranged at the end of the machine. A spinning can 3 is positioned at each of the spinning stations 2 and is equipped with a supply of feed material, for example with a sliver 25.

The spinning stations 2 furthermore each have a drafting system 4, an air-jet spinning device 5, a draw-off device 6, a thread cleaner 7 and a thread-checking device 8 which ensures that the thread 36 spun or produced from the sliver 25 in the air-jet spinning device 5 is wound in crossing layers onto a take-up bobbin 9. The so-called cross-wound bobbin 9 produced during the spinning process is in each case held in a bobbin frame (not shown), as is customary, and is rotated by a bobbin drive (also not shown).

Each of the spinning stations 2 is also equipped with a thread take-up device 39 which makes it possible to take up a thread end 37 of a manufactured thread 36 that has run onto the cross-wound bobbin 9 after an interruption of spinning and to transfer it to a so-called thread preparation device 40 arranged in the region of the draw-off device 6.

FIG. 2 shows, in a side view and a larger scale, an air-jet spinning device 5 suitable for carrying out the method according to a preferred embodiment during the piecing process.

As can be seen, the drafting system 4 for drafting the sliver 25 is upstream form the air-jet spinning device 5 shown in section. Downstream from the air-jet spinning device 5 in the sliver running direction R is a take-off device 6 which can be driven reversibly by an individual motor and ensures that the finished thread 36 can be conveyed in the direction of the take-up bobbin 9 and in the opposite direction thereto.

In addition, the thread preparation device 40, which is not shown in more detail here, is arranged in the region of the thread take-off device 6 which prepares the thread end 37 of the finished thread 36, which has been retrieved by the yarn take-up device 39, for the subsequent piecing process.

As shown in FIG. 2, the air-jet spinning device 5 basically consists of a two-part outer housing 14, 15, an expansion housing 16, a nozzle block 17, a sliver guide 18 and a hollow spinning cone 19.

In this case, the expansion housing 16, in conjunction with the front housing part 14 of the outer housing, forms a front annular space 20 which is connected to an overpressure source 22 via a pneumatic line 21 and is connected to the expansion space 28 arranged in the rear housing part 15 of the outer housing.

While the expansion space 28 is indirectly connected to the ambient atmosphere via an exhaust air channel 29, the annular space 20 is pneumatically continuously connected to at least one blowing air nozzle 23 which are arranged in the nozzle block 17.

The blowing air nozzle 23 opens into a vortex chamber 33 in the region upstream from the inlet opening 35 of the spinning cone 19 and is thus directed onto the head 24 of the spinning cone 19 in such a way that a rotating air flow is created on the latter. The spinning cone 19 is preferably made of a highly wear-resistant material, for example a technical ceramic material.

To control the supply of compressed air, the pneumatic line 21 is equipped with a valve 32, the actuation of which preferably takes place by a spinning station's control unit 38 which is connected to the valve via corresponding control lines.

During the normal, previously known spinning process, which is not shown here, the sliver 25, which is stored in a spinning can 3, first passes through the drafting system 4 on its way to the cross-wound bobbin 9, where it is strongly drafted. Via the exit roller pair 26 of the drafting system 4, the stretched sliver 25 is then transferred into the region of the inlet opening 27 of the air-jet spinning device 5 and is sucked into the vortex chamber 33 of the air-jet spinning device 5 under the influence of a negative pressure flow present there. Inside the air-jet spinning device 5, the stretched sliver 25 passes via the sliver guide 18 and the nozzle block 17 to the inlet opening 35 of the hollow spinning cone 19 and is drawn into the spinning cone 19 by the thread 36 forming within the spinning cone 19. In so doing, the sliver 25 is exposed to the influence of a rotational flow in the region of the head 24 of the spinning cone 19 which is generated by the air flow exiting the nozzle block 17.

The valve 32 is open for the defined supply of this air flow to the nozzle block 17 initiated by the overpressure source 22. In order to enable the outflow of the air flow flowing in via the nozzle block 17 through the exhaust air duct 29 to the ambient atmosphere or to the machine's own suction during the spinning process, a valve 34 connected to the control unit 38 via a corresponding control line is open.

During the spinning process, due to the continuous movement of the sliver 25 in the sliver running direction R, the sliver 25 is continuously drawn into the hollow spinning cone 19, wherein the edge fibers are wound helically around the core fibers of the sliver 25. The thread 36 produced thereby is pulled out of the air-jet spinning device 5 by means of the thread withdrawal device 6 and subsequently wound into a cross-wound bobbin 9.

If an interruption of spinning occurs during the spinning process, for example due to a breaking of the sliver 25 or due to a controlled cut of the already spun thread 36 by the thread cleaner 7, a piecing process must first be carried out before a restart of the spinning process.

As is known, to carry out a piecing process, on the one hand the stretched sliver 25 and on the other hand the already finished thread 36 which has run onto the cross-wound bobbin 9 are required.

After an interruption of spinning, the spinning station's thread take-up device 39 of the relevant spinning station 2 first retrieves the thread end 37 of the already completed thread 36 from the cross-wound bobbin 9 and transfers it to a thread preparation device 40 arranged downstream from the air-jet spinning device 5 in the sliver running direction R.

There, the yarn end 37 is freed from twist and loose fibers as far as possible and then transferred to the vortex chamber 33 for piecing and positioned there.

To prepare the sliver 25, during the return of the thread end 37 into the vortex chamber 33, the drafting system 4 is operated by the control unit in a combing mode in which the first drafting system roller pair 42, the second drafting system roller pair 43, and the apron roller pair 41 are at a standstill, whereas the exit roller pair 26 is operated at a combing-out speed, and the free end of the sliver 25 is thereby prepared in an optimal manner for the piecing process.

LIST OF REFERENCE SIGNS

1 Air-jet spinning machine
2 Spinning position
3 Spinning can
4 Drawing system
5 Air-jet spinning device
6 Take-off device
7 Thread cleaner
8 Thread traversing device
9 Take-up bobbin
13A, 13B Machine frame
14 Outer housing
15 Outer housing
16 Expansion housing
17 Nozzle block
18 Sliver guide
19 Spinning cone
25 Sliver
26 Exit roller pair
28 Expansion space
29 Exhaust duct
32 Valve
33 Vortex chamber
34 Valve
35 Inlet opening
36 Thread
37 Thread end
38 Control unit
39 Thread take-up device
40 Thread preparation device
41 Apron roller pair

The invention claimed is:

1. A method for operating a drafting system having an exit roller pair and at least one additional drafting system roller pair and/or apron roller pair, the method comprising:

supplying a sliver to a spinning station of an air-jet spinning machine for producing a thread to a vortex chamber of an air-jet spinning device of the spinning station;

decoupled driving of the exit roller pair from the at least one additional drafting system roller pair and/or the apron roller pair;

driving the exit roller pair at a predetermined combing-out speed for combing out the sliver after an interruption of spinning;

wherein the at least one additional drafting system roller pair and/or the apron roller pair located upstream of the exit roller pair in the sliver running direction is stopped or operated at a holding speed which is associated with the combing-out speed and which amounts to a max. 10% of the combing-out speed; and stopping the drafting system combing and then powering up the drafting system for piecing.

2. The method according to claim 1, wherein driving the exit roller pair occurs before the at least one additional drafting system roller pair and/or the apron roller pair when the drafting system is powered up during piecing.

3. A drafting system for conveying a sliver in the direction of an inlet opening of a vortex chamber of an air-jet spinning device, the drafting system comprising:

an exit roller pair which can be driven decoupled from at least one additional drafting system roller pair and/or apron roller pair; and a control unit for carrying out the method for operating the drafting system according to claim 2 after an interruption of spinning.

4. The drafting system according to claim 3, wherein the control unit is integrated into a central control unit of the air-jet spinning machine.

5. The drafting system according to claim 4, wherein the control unit is designed to variably adjust the combing-out speed and/or the holding speed.

6. The drafting system according to claim 3, wherein the control unit is designed to variably adjust the combing-out speed and/or the holding speed.

7. A drafting system for conveying a sliver in the direction of an inlet opening of a vortex chamber of an air-jet spinning device, the drafting system comprising:

an exit roller pair which can be driven decoupled from at least one additional drafting system roller pair and/or apron roller pair; and a control unit for carrying out the method for operating the drafting system according to claim 1 after an interruption of spinning.

8. The drafting system according to claim 7, wherein the control unit is integrated into a central control unit of the air-jet spinning machine.

9. The drafting system according to claim 8, wherein the control unit is designed to variably adjust the combing-out speed and/or the holding speed.

10. The drafting system according to claim 7, wherein the control unit is designed to variably adjust the combing-out speed and/or the holding speed.

* * * * *